US008341989B1

(12) United States Patent
Hamblin et al.

(10) Patent No.: US 8,341,989 B1
(45) Date of Patent: Jan. 1, 2013

(54) KEY FOB WITH RETRACTABLE KEY BLANK

(75) Inventors: Ryan J. Hamblin, Apache Junction, AZ (US); Michael Allen Mueller, Phoenix, AZ (US)

(73) Assignee: M.C.M. Technologies, Providence, RI (US)

( * ) Notice: Subject to any disclaimer, the term of this patent is extended or adjusted under 35 U.S.C. 154(b) by 0 days.

(21) Appl. No.: 13/087,015

(22) Filed: Apr. 14, 2011

Related U.S. Application Data

(60) Provisional application No. 61/328,995, filed on Apr. 28, 2010.

(51) Int. Cl.
*A45C 11/00* (2006.01)
*A45C 11/32* (2006.01)

(52) U.S. Cl. ..... 70/456 R; 70/408; D3/208; D3/209; D3/210; D3/211; D3/212

(58) Field of Classification Search ..... 70/456 R; D3/208–212
See application file for complete search history.

(56) References Cited

U.S. PATENT DOCUMENTS

| | | | | |
|---|---|---|---|---|
| 3,427,834 | A * | 2/1969 | Tutino | 70/414 |
| 6,314,775 | B2 * | 11/2001 | Schwab | 70/456 R |
| 7,055,352 | B2 * | 6/2006 | Meyerson et al. | 70/456 R |
| 7,127,922 | B2 * | 10/2006 | Khounsombath et al. | 70/456 R |
| 2010/0000885 | A1 * | 1/2010 | Downes | 206/37.2 |
| 2011/0072870 | A1 * | 3/2011 | Downes | 70/456 R |

* cited by examiner

*Primary Examiner* — Suzanne Barrett
*Assistant Examiner* — Ifeolu Adeboyejo
(74) *Attorney, Agent, or Firm* — Schmeiser, Olsen & Watts LLP

(57) ABSTRACT

A key fob with a retractable key blank is provided. The present invention includes a housing having a first portion and a second portion coupled together. The housing includes an aperture formed between the first and second portions on an end of the housing. The aperture allows for a key blade to slide therethrough. The present invention further includes a key blank having a base portion and a blade portion, wherein the base portion is coupled to an activation mechanism and the blade extends from the base portion. The base portion is slideable within the housing and retained at all times within the housing. The blade portion slides out and in the housing in response to operation of the activation mechanism. The blade portion slides between an extended portion and a refracted position. The key blank is cuttable while coupled to the housing.

15 Claims, 7 Drawing Sheets

KEY FOB WITH RETRACTABLE KEY BLANK

CROSS REFERENCE TO RELATED APPLICATION[S]

This application claims priority to U.S. Provisional Patent Application entitled "KEY FOB WITH RETRACTABLE KEY BLANK," Ser. No. 61/328,995, filed Apr. 28, 2010, the disclosure of which is hereby incorporated entirely herein by reference.

BACKGROUND OF THE INVENTION

1. Technical Field

This invention relates generally to a key blank and more particularly to a key fob with a retractable key blank, wherein the key blank is configured to be cut without removal from the key fob.

2. State of the Art

Keys are an important part of life for most people in the world. Keys are utilized for vehicles, homes, businesses and the like. Keys allow for the unlocking of various types of locks, as well as for ignition purposes of vehicles. Keys have become essentially a necessity in a typical person's life.

Because keys are so commonly used, they are also commonly lost, worn out or require additional copies in order to accommodate multiple users of the lock. For example, a family occupying a home may need multiple keys for all inhabitants to be able to lock and unlock exterior doors. Other examples include multiple drivers of a vehicle require the copies of the same key if sharing of a common key is not desired or not practical.

Conventional copies of keys are produced from a blank key, wherein the blank key has common grooves to the key to be replicated. A follower is employed to follow the bit pattern of a key to ensure that the series tumblers are engaged in order to unlock the lock. Various types of conventional keys are able to be replicated. Further, other conventional means may be employed to duplicate a key.

Further, there are various styles of keys; however, there is not a key blank that also incorporates the benefits of a retractable key. Retractable keys allow a user to keep the key portion hidden and otherwise protected from damage and further make transportation easier.

Accordingly, there is a need for a key fob with a retractable key blank.

DISCLOSURE OF THE INVENTION

The present invention relates to a key fob with a retractable key blank, wherein the key blank is cuttable while coupled to the key fob. The key fob allows for two discrete positions, an extended position with the key fully extended and a retracted position with the key retained within the key fob.

Aspects of the present invention include a key fob with a retractable key blank. The present invention includes a housing, the housing having a first portion and a second portion, wherein the first and second portions are coupled together. When the first and second portions are coupled together, the housing includes an aperture formed between the first and second portions. The aperture allows for a key blade to slide therethrough. The present invention further includes a key blank having a base portion and a blade portion, wherein the base portion is coupled to an activation mechanism and the blade extends from the base portion. The base portion is slideable within the housing and retained at all times within the housing. The blade portion slides in and out of the housing in response to operation of the activation mechanism. The blade portion slides between an extended position and a retracted position. The key blank can be duplicated from an original key while coupled to the housing.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1A:
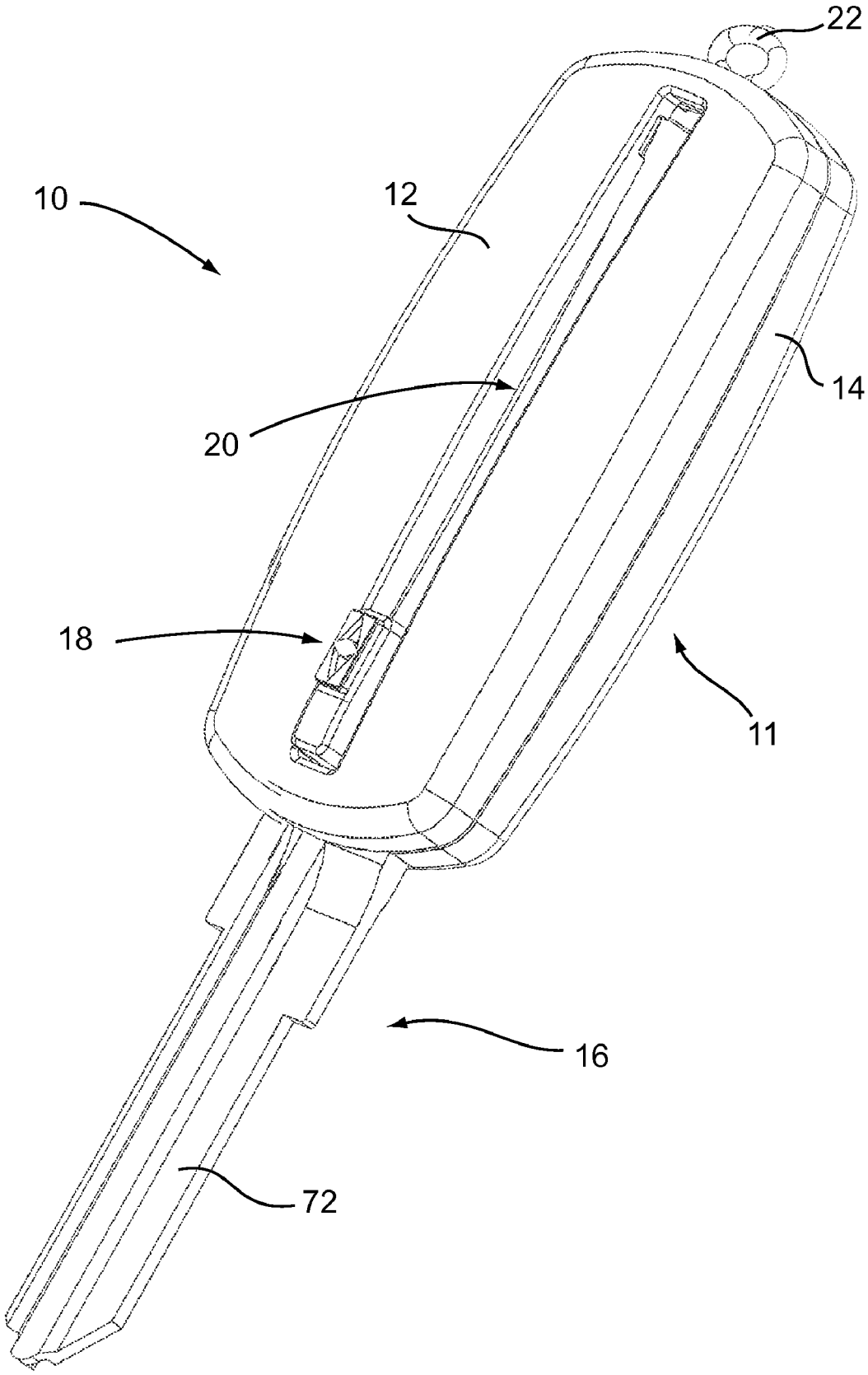
FIG. 1*a* is a perspective view of a key fob having a retractable key blank in the extended position.
Figure 1B:
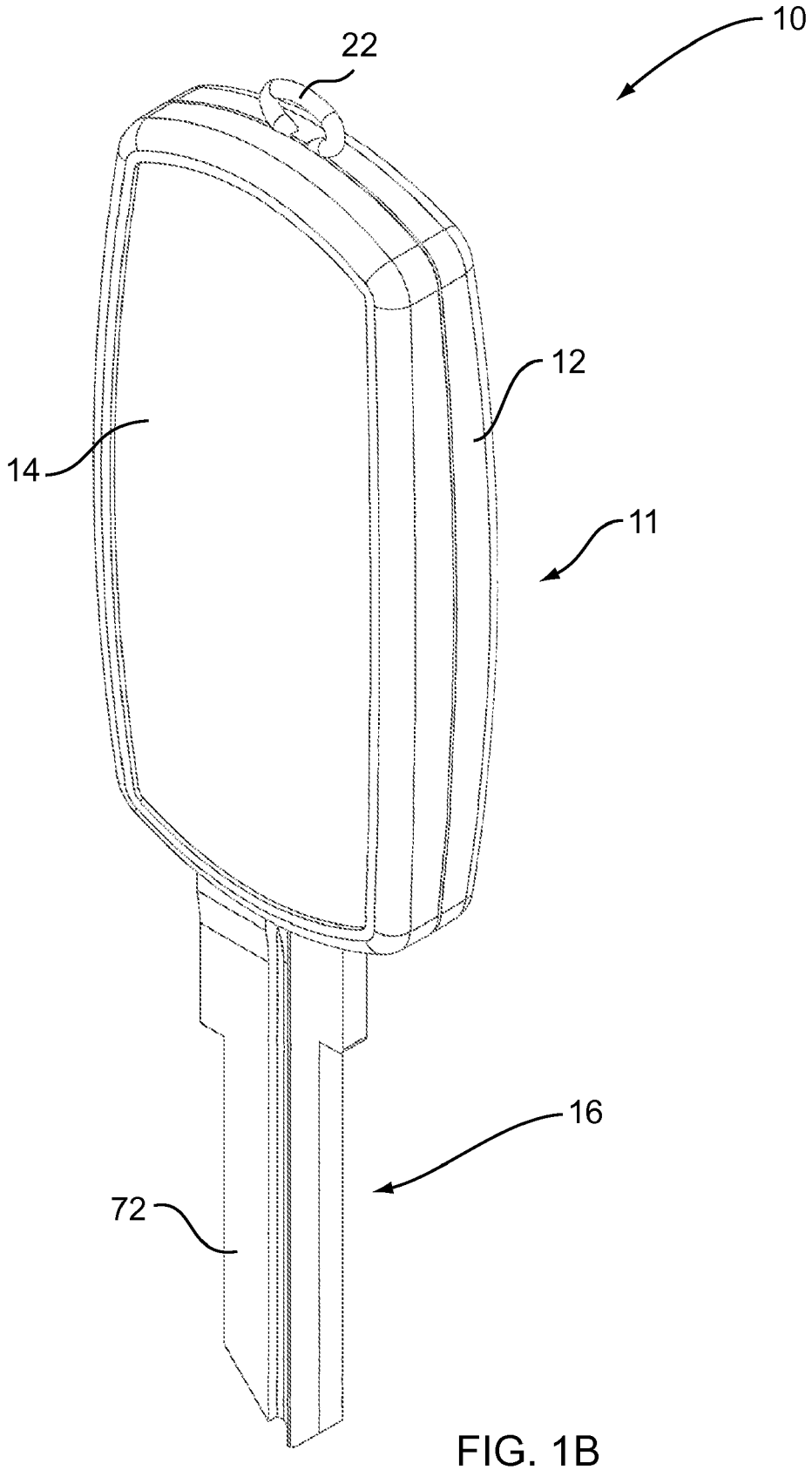
FIG. 1*b* is another perspective view of a key fob having a retractable key blank in the extended position.
Figure 1C:
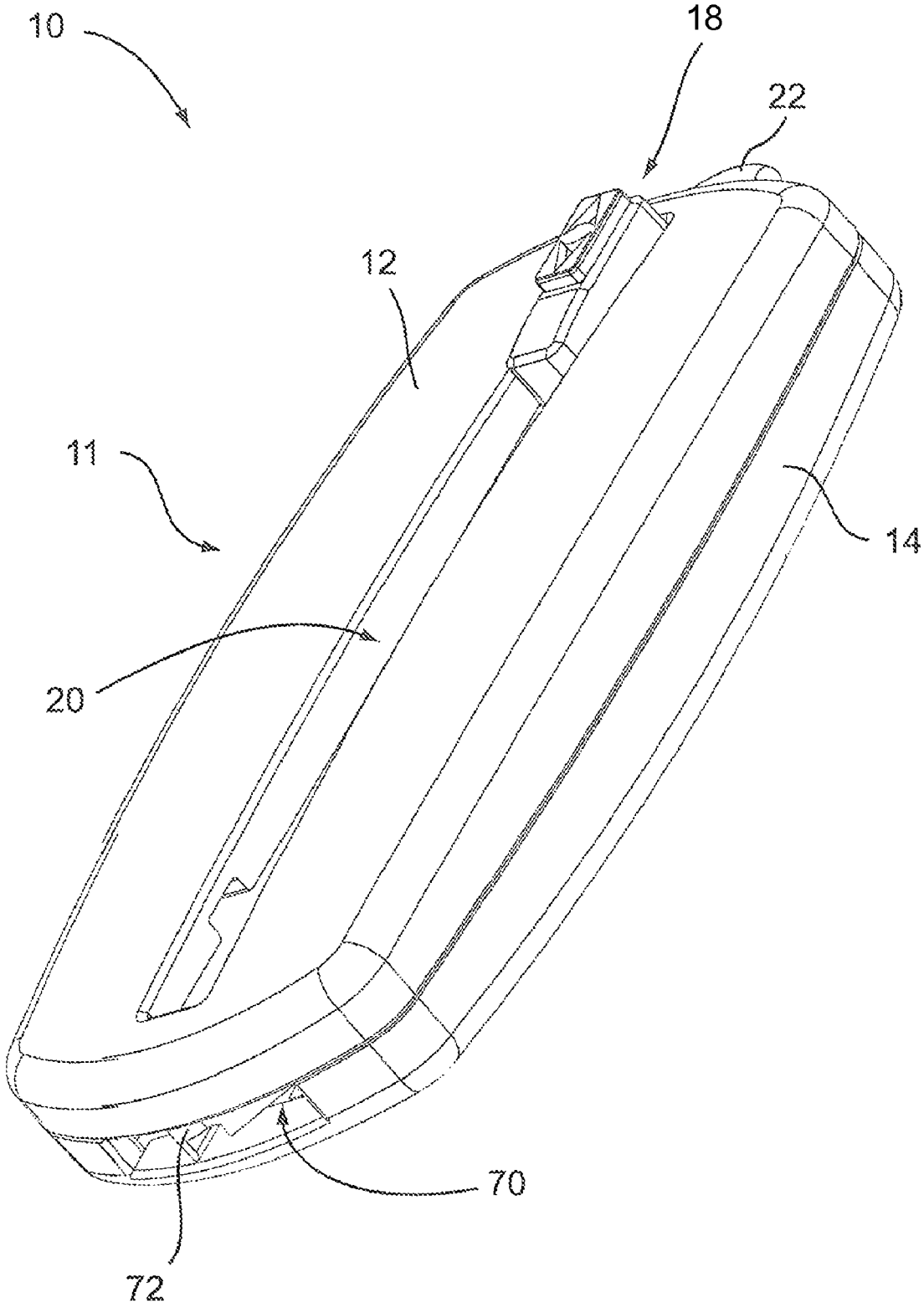
FIG. 1*c* is a perspective view of the key fob having a retractable key blank in the retracted position.
Figure 1D:
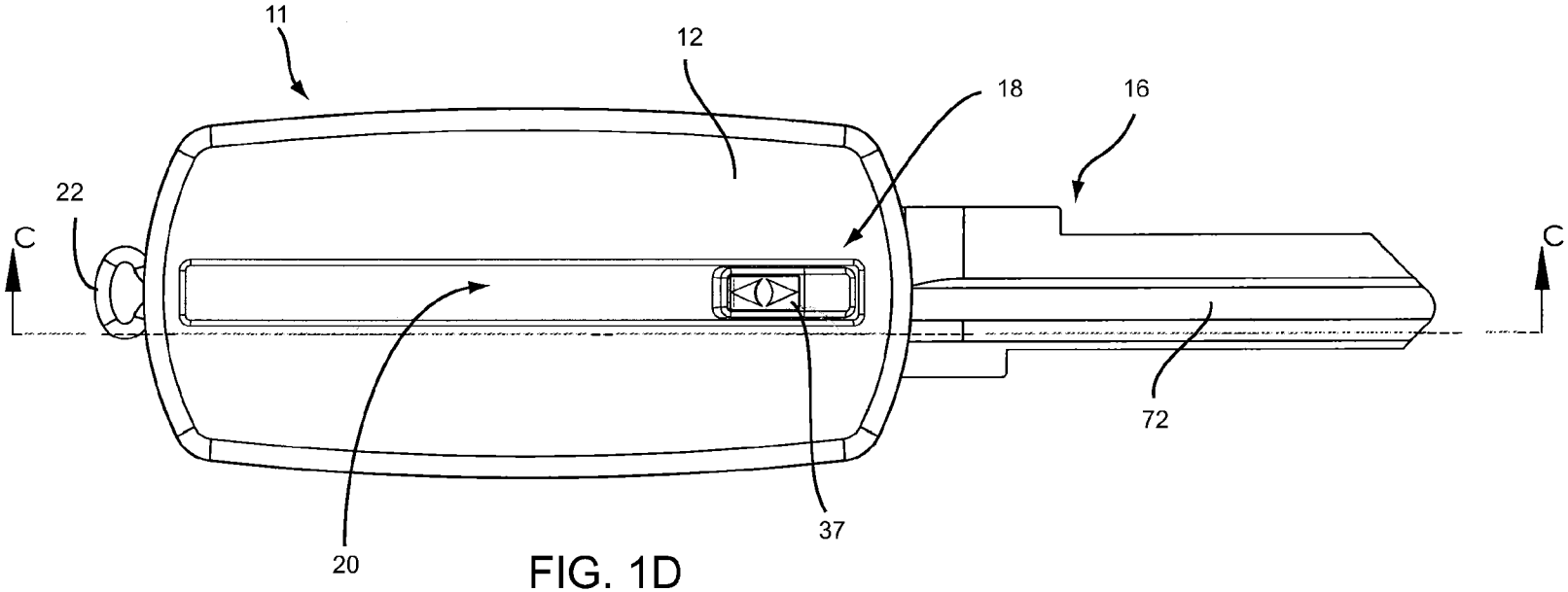
FIG. 1*d* is a plan view of a key fob having a retractable key blank in the extended position.

As discussed above, embodiments of the present invention relate to a retractable key blank, wherein the key blank is cuttable while coupled to the key fob. The key fob allows for two discrete positions, an extended position with the key fully extended and a retracted position with the key retained within the key fob. The present invention includes a very limited number of parts that lends itself to better reliability and prone to less failure by having few moving parts.

Referring to the drawings, FIGS. 1*a*-1*d* depicts a key fob 10 with a retractable key blank according to particular embodiments of the present invention. The key fob 10 comprises a housing 11 having a first portion 12 and a second portion 14, wherein the first portion 12 and the second portion 14 are coupled together and have an open space between the portions. The housing includes a key blade aperture 70 located on one end of the housing 11. While it is shown that the aperture 70 is defined by a groove on the bottom portion 14 and an edge of the top portion 12, other configurations are available, such as a groove in the top portion 12 and an edge of the bottom portion 14 or corresponding grooves in each the top portion 12 and the bottom portion 14. The housing 11 further comprises a slot 20 extending along a length of the first portion 12, wherein the slot 20 is an aperture through the first portion 12.

The second portion 14 may further include graphics, written indicia and the like coupled to the side facing away from the first portion 12. In particular embodiments the graphics may be a form of advertising, such as, by a company or business that is promoting other goods and/or services. Additionally, the graphics may be removably coupled to the second portion 14 in some embodiments.

The key fob 10 further comprises a key blank 16, wherein the key blank 16 is in a sliding engagement with the housing 11. The key blank has a key blade 72 and a base 74 (shown in FIGS. 2-3*b*). The base 74 of the key blank 16 is coupled to an activation mechanism 18, wherein the activation mechanism 18 engages the slot 20 and operates to slide the key blank 16 between an extended position shown in FIG. 1*a* wherein the blade 72 is fully extended out of the housing 11 and a retracted position shown in FIG. 1*c* with the blade 72 fully retracted within the housing 11. The activation mechanism 18 also locks the key blank 16 in the extended and refracted position.

The key fob 10 further comprises a loop device 22, wherein the loop device 22 is coupled to the housing 11. The loop device 22 functions as a means to connect the key fob 10 to a key ring, a key chain, a lanyard and the like.

Figure 2:
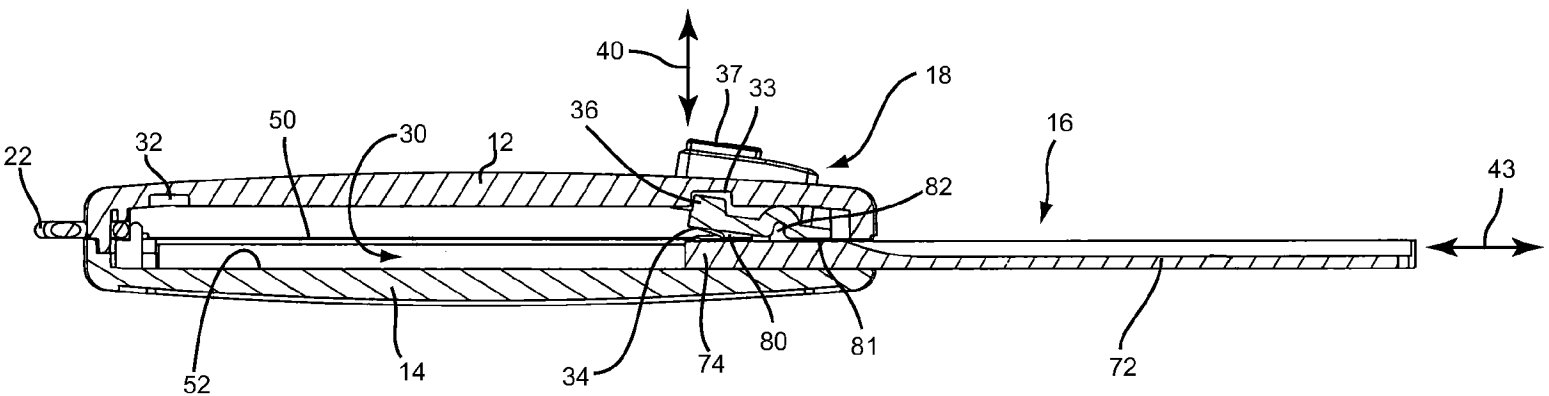
FIG. 2 is a section view the key fob with a retractable key blank taken along line C-C of FIG. 1*d*.
Figure 3A:
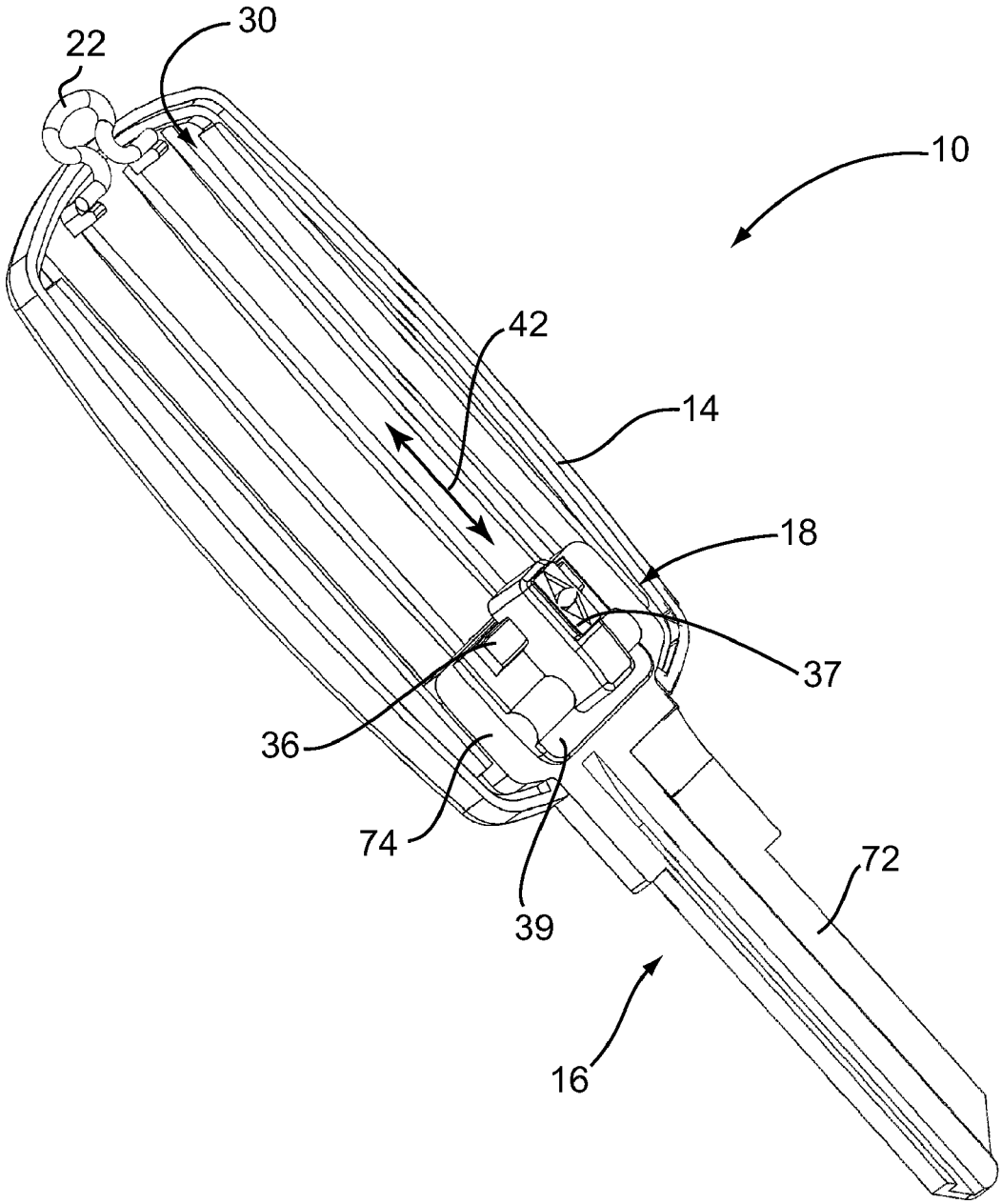
FIG. 3*a* is a perspective view of a key fob with a retractable key blank with the first portion of the housing removed.
Figure 3B:
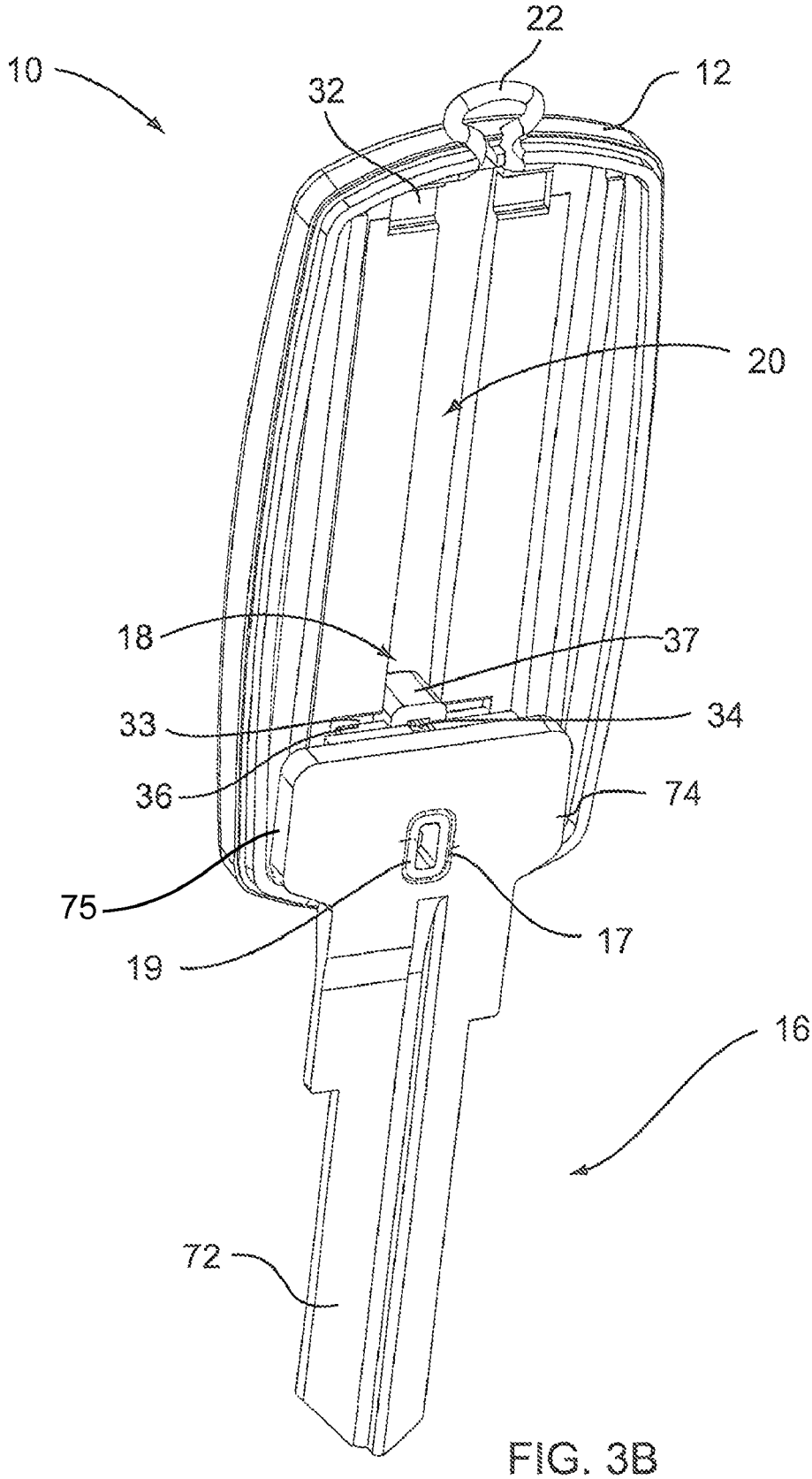
FIG. 3*b* is a perspective view of a key fob with a retractable key blank with the second portion of the housing removed.
Figure 4:
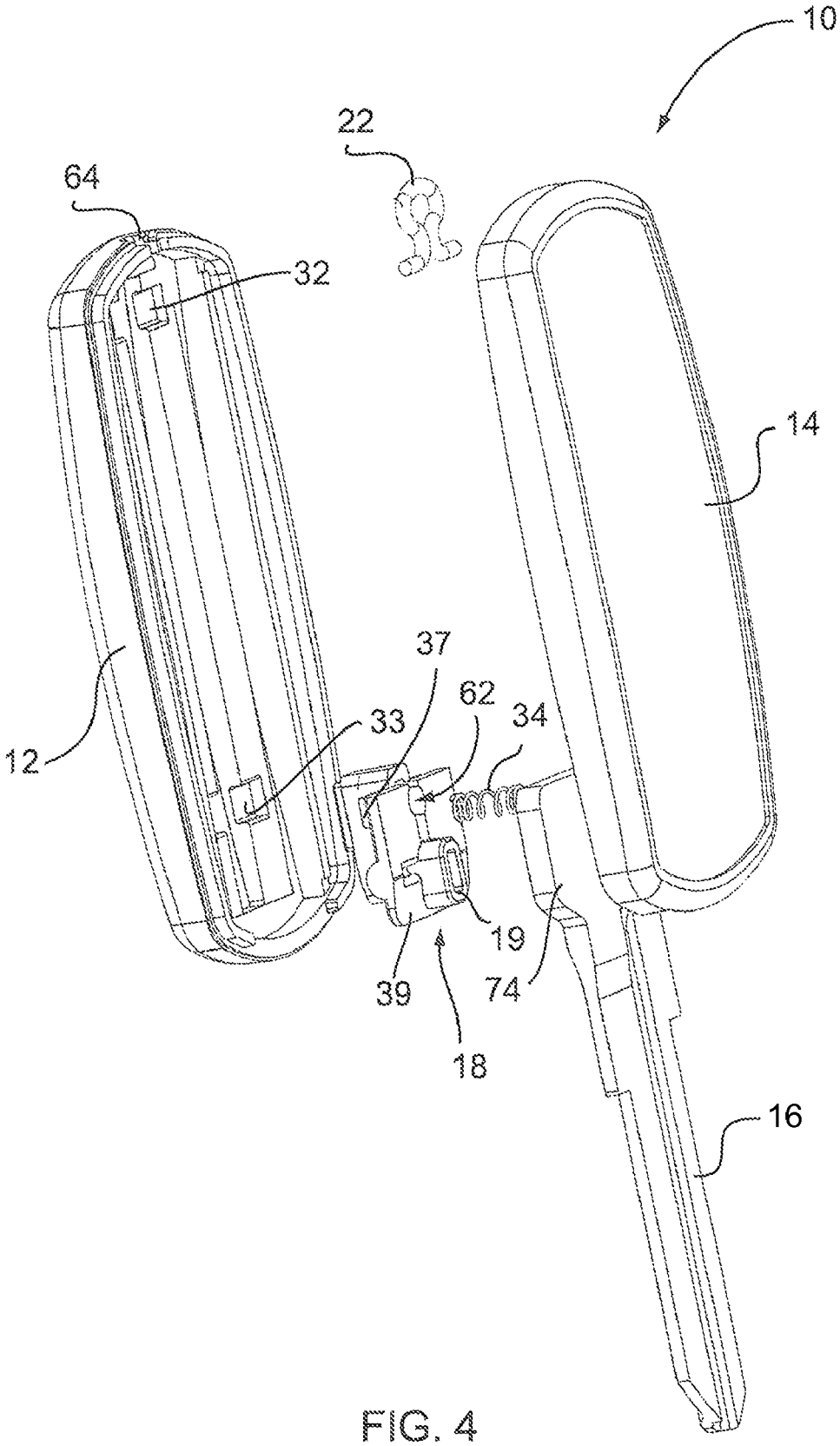
FIG. 4 is an exploded view of a key fob with a retractable key blank.

Referring again to the drawings, FIGS. 2-4 depict the key fob 10. As shown, the housing 11 further includes channels 30 on opposing sides of the housing 11. The channels 30 slidingly receive edge portions 75 of the base 74 of the key blank 16. This allows the key blank 16 to slide with respect to the housing 11 and maintain its proper orientation so as to easily move between the extended and retracted position. The channels 30 further serve to keep the key blank 16 and blade 72 from rotating during use of the key once it has been cut. The channels 30 extend along a length of the housing and serve as one means of defining the range of sliding motion of the key blank 16. The channels 30 are formed when the first portion 12 and the second portion 14 are coupled together and are defined between ridge 50 of the top portion 12 and ridge 52 of the bottom portion 14.

The activation mechanism 18 is coupled to a base 74 of the key blank 16. The activation mechanism 18 includes a base 39, a biased protrusion 37, a connecting protrusion 19, a spring recess 62 and a spring 34. The base 74 of the key blank 16 further includes an aperture 17. The activation mechanism 18 is coupled to the base 74 of the key blank 16, wherein the connecting protrusion 19 is received within the aperture 17 of the base 74 of the key blank 16. The base 39 of the activation mechanism 18 contacts the surface of the base 74 of the key blank 16. The spring 34 is retained within the spring recess 62 of the activation mechanism 18, wherein the surface of the base 74 of the key blank 16 operates to retain the spring 34 within the spring recess 62. The spring 34 functions to bias the biased protrusion 37 along direction indicator 40 away from the base 74 of the key blank 16. The biased protrusion 37 may be depressed toward the base 74 of the key blank 16 along direction indicator 40 to place the key blank 16 in a condition to slide between the retracted and extended positions. The activation mechanism 18 may be retained in its coupling with the key blank 16 by the engagement of the housing 11 around the base portion 74 of the key blank 16 and the activation mechanism 18 and the retaining of the biased protrusion 37 within slot 20 as the biased protrusion 37 extends through slot 20.

The activation mechanism 18 further includes locking protrusions 36 coupled on opposing sides of the biased protrusion 37. The locking protrusions 36 engage recesses 32 and 33 of the first portion 12 of the housing 11 when the locking protrusions 36 are aligned with the recesses 32 and 33 and when the biased protrusion 37 is in its resting biased position. By depressing the biased protrusion 37 along direction arrow 40, the locking protrusions 36 are disengaged from one of the recesses 32 or 33 and the key blank 16 is then in a position to slide to an extended or retracted position respectively. The locking protrusions 36 function to lock the key blank 16 in the retracted position when engaged with recesses 32 and in the extended position when engaged with the recesses 33. Further, the biased protrusion 37 has an additional functionality, wherein force may be applied to depress the biased protrusion 37 and an additional force may be applied simultaneously in a direction indicated by dual arrow 42. Accordingly, the key blank 16 is then moved between the extended and retracted position in response to applying two transverse forces to the biased protrusion 37.

As shown in FIG. 2, the base 39 of the activation mechanism 18 has two surfaces 80 and 81 that are at different angles. This variation of angles of two surfaces of the base 39 function to create a rotation point or axis at rotation point 82. The surfaces 80 and 81 further function to control the range of motion of the activation mechanism 18. The activation mechanism 18 may only rotate the angle defined by the angle between surfaces 80 and 81, wherein the angle of rotation is the supplementary angle of the angle measured between surfaces 80 and 81. As can further be seen in FIG. 2, spring 34 biases the biased portion 37 away from the key blank 16, and engages the locking protrusions 36 within recesses 33 or recesses 32.

Further, with the key 16 in an extended position, as force is applied to the key blank 16 or key blade 72 along direction 43, the locking protrusion 36 is directed up and further into the recess 33, the resistance to sliding is increased with increased force applied in direction 43. This is possible based on the biasing effect of the spring 34 and the differentiation of the surfaces 80 and 81. It provides a motion of engagement similar to a ratchet mechanism.

It will be understood that the aperture 70 in the housing 11 is of a size smaller than the base 74 of the key blank 16. This size differential prevents the key blank 16 from being removed from within the housing 11 while allowing the blade 72 to be extended and retracted from the housing 11.

Further, the top portion 12 of the housing may also have slot 64 for receiving the loop portion 22. This allows the loop portion 22 to be retained in position extending from the housing on a side opposite the aperture 70.

Additionally, the housing 11 may be easily customizable. The housing allows for ease of decoration, application of graphics, engraving and the like to achieve a customized design. For example, the housing 11 may be printed directly onto to display graphics, written indicia and the like. Further, such decoration and customization may be utilized to better market the product, such as providing housings with professional sports teams or athletes, actors and actresses, movies, cartoon characters, brand names, logos and the like.

Another embodiment of the present invention includes a method of using the key fob with a retractable key blank. The method may include providing a key fob with a retractable key blank, wherein the key blank is one of various types of key blade configurations; selecting a key fob with a key blank matching a type of an existing key; extending the key blade from the within a housing of the key fob; and duplicating the key blade to match an existing key. The duplicating of the key blade may be performed by use of most key duplicating machines.

Once the key is cut, a user may then place the key blade in a retracted position when the key is not in use. At times when a user wishes to operate the key, the user may extend the key blade from the housing and lock it in the extended position. The key then operates as a normal key. Once use of the key is complete, the user may then move the key blade and lock it in the retracted position.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A key fob with a retractable key blank, the key fob comprising:

a housing, the housing having a first portion and a second portion, wherein the first and second portions are coupled together;

an aperture formed between the first and second portions when the first and second portions are coupled together;

an activation mechanism operatively coupled within the housing, the activation mechanism comprising a base, a biased protrusion, a connecting protrusion, a spring recess, a spring, and locking protrusions coupled on opposing sides of the biased protrusion; and a key blank having a base portion and a blade portion extending from the base portion, wherein the base portion is slideable within the housing and retained at all times within the housing and the blade portion slides in and out of the aperture of the housing in response to sliding the base portion within the housing, wherein the blade portion of the key blank is duplicated from an original key while coupled to the housing, wherein:

the connecting protrusion is received within an aperture of the base portion of the key blank and the spring is retained within the spring recess of the activation mechanism;

the surface of the base portion of the key blank operates to retain the spring within the spring recess and the spring functions to bias the biased protrusion away from the base portion of the key blank; and the locking protrusions engage first or second recesses of the first portion of the housing when the locking protrusions are aligned with the first or second recesses.

2. The key fob of claim 1, wherein the activation mechanism is operatively coupled within the housing, wherein the base portion of the key blank is coupled to the activation mechanism.

3. The key fob of claim 2, wherein the blade portion of the key blank slides in and out of the aperture of the housing in response to operation of the activation mechanism.

4. The key fob of claim 3, wherein the blade portion of the key blank slides between an extended position and a retracted position, wherein the extended position comprises the blade portion extending from the housing and the retracted position comprises the blade portion retained completely within the housing.

5. The key fob of claim 1, wherein the housing further comprises channels on opposing sides of the housing, wherein the channels slidingly receive edge portions of the base portion of the key blank.

6. The key fob of claim 5, wherein the channels are formed when the first portion and the second portion of the housing are coupled together and are defined between a ridge of the top portion and a ridge of the bottom portion.

7. The key fob of claim 6, wherein the channels extend along a length of the housing and serve as one means of defining the range of sliding motion of the key blank and serves to keep the key blank from rotating during use of the key blank once it has been cut.

8. A key fob with a retractable key blank, the key fob comprising:

a housing, the housing having a first portion and a second portion, wherein the first and second portions are coupled together;

an aperture formed between the first and second portions when the first and second portions are coupled together;

an activation mechanism operatively coupled within the housing, the activation mechanism comprising a base, a biased protrusion, a connecting protrusion, a spring recess, a spring, and locking protrusions coupled on opposing sides of the biased protrusion; and a key blank having a base portion and a blade portion extending from the base portion, wherein the base portion is coupled to the activation mechanism and the blade portion slides in and out of the aperture of the housing in response to operation of the activation mechanism, wherein the blade portion of the key blank is duplicated from an original key while coupled to the housing, wherein:

the connecting protrusion is received within an aperture of the base portion of the key blank and the spring is retained within the spring recess of the activation mechanism;

the surface of the base portion of the key blank operates to retain the spring within the spring recess and the spring functions to bias the biased protrusion away from the base portion of the key blank; and the locking protrusions engage first or second recesses of the first portion of the housing when the locking protrusions are aligned with the first or second recesses.

9. The key fob of claim 8, wherein the blade portion of the key blank slides between an extended position and a retracted position, wherein the extended position comprises the blade portion extending from the housing and the retracted position comprises the blade portion retained completely within the housing.

10. The key fob of claim 8, wherein the base of the activation mechanism contacts a surface of the base portion of the key blank.

11. The key fob of claim 8, wherein the biased protrusion may be depressed toward the base portion of the key blank to place the key blank in a condition to slide between a retracted and an extended position.

12. The key fob of claim 11, wherein the activation mechanism is retained in its coupling with the key blank in response to an engagement of the housing around the base portion of the key blank and the activation mechanism, wherein the biased protrusion is retained within a slot of the housing as the biased protrusion extends through slot.

13. The key fob of claim 8, wherein the locking protrusions function to lock the key blank in the refracted position when engaged with first recesses and in the extended position when engaged with the second recesses.

14. The key fob of claim 13, wherein with the key blade in the extended position, in response to force applied to the key blade in a direction opposite from the direction the key is extending, the locking protrusions are directed up and further into the recesses providing resistance to sliding, wherein the resistance to sliding is increased with increased force.

15. A key fob with a retractable key blank, the key fob comprising:

a housing, the housing having a first portion and a second portion, wherein the first and second portions are coupled together;

an aperture formed between the first and second portions when the first and second portions are coupled together;

an activation mechanism operatively coupled within the housing, the activation mechanism comprising a base, a biased protrusion, a connecting protrusion, a spring recess, a spring, and locking protrusions coupled on opposing sides of the biased protrusion; and a key blank having a base portion and a blade portion extending from the base portion, wherein the base portion is coupled to the activation mechanism and the blade portion slides in and out of the aperture of the housing in response to operation of the activation mechanism, wherein the activation mechanism comprises locking protrusions that engage first or second recesses of the first portion of the housing when the locking protrusions are aligned with the first or second recesses, wherein:

the connecting protrusion is received within an aperture of the base portion of the key blank and the spring is retained within the spring recess of the activation mechanism;

the surface of the base portion of the key blank operates to retain the spring within the spring recess and the spring functions to bias the biased protrusion away from the base portion of the key blank; and the locking protrusions engage first or second recesses of the first portion of the housing when the locking protrusions are aligned with the first or second recesses, the locking protrusions function to lock the key blank in the retracted position when engaged with first recesses and in the extended position when engaged with the second recesses; and with the key blade in the extended position, in response to force applied to the key blade in a direction opposite from the direction the key is extending, the locking protrusions are directed up and further into the recesses providing resistance to sliding, wherein the resistance to sliding is increased with increased force.

* * * * *